United States Patent [19]

Lapeyre et al.

[11] 4,424,686

[45] Jan. 10, 1984

[54] FLOOR MOUNTED AIR CONDITIONER

[75] Inventors: James M. Lapeyre, New Orleans, La.; Noel A. Svendsen, Marblehead, Mass.; Richard S. Lindberg, Shrewsbury, Mass.; Raymond J. Carroll, Jr., Billerica, Mass.

[73] Assignee: The Laitram Corporation, New Orleans, La.

[21] Appl. No.: 241,947

[22] Filed: Mar. 9, 1981

[51] Int. Cl.[3] ..... F25D 23/12

[52] U.S. Cl. ..... 62/259.1; 62/263; 62/279; 62/285; 62/305; 62/315; 62/DIG. 16

[58] Field of Search ..... 62/507, 508, 259, 263, 62/279, 285, 305, 315, DIG. 16; 165/125

[56] References Cited

U.S. PATENT DOCUMENTS

| | | | |
|---|---|---|---|
| 3,102,397 | 9/1963 | Trucchi | 62/507 |
| 4,203,302 | 5/1980 | Lapeyre | 62/285 |
| 4,321,803 | 3/1982 | Smith | 165/125 X |

*Primary Examiner*—Albert J. Makay
*Assistant Examiner*—Henry Bennett
*Attorney, Agent, or Firm*—Weingarten, Schurgin, Gagnebin & Hayes

[57] ABSTRACT

A floor mounted air conditioner comprising a housing containing condenser coils disposed in a conical configuration about a normally vertical axis, and cylindrically configured evaporator coils coaxially disposed above the condenser coils. A drip pan separates the condenser and evaporator coils and includes openings for discharging condensate onto the condenser coils for evaporation. A condenser fan associated with a bottom duct adapted for installation in a mounting opening in the floor of a room blows hot air through the mounting opening, and an evaporator fan is associated with a top duct for blowing cool air into the room being cooled. Another fan is provided for blowing cool air over the compressor.

10 Claims, 1 Drawing Figure

FLOOR MOUNTED AIR CONDITIONER

FIELD OF THE INVENTION

This invention relates to air conditioners and, more particularly, to an air conditioner especially adapted for mounting in an opening of a floor.

BACKGROUND OF THE INVENTION

Air conditioners are very well known and are constructed in many different forms to suit the particular cooling requirements of a facility. In a typical self-contained air conditioning unit such as employed to cool one or more rooms of a building, a refrigeration system containing a compressor and associated cooling and evaporator coils and blowers is contained within a suitable housing which is usually constructed for mounting in a window or wall opening of a building. It is desirable to provide an air conditioner which can be installed such as not to mar the appearance of a building by the unsightly protrusion of air conditioning units from the walls or windows thereof and to provide an air conditioner which is adapted for more efficient mounting and operation. Such an air conditioner having these desirable characteristics is shown in U.S. Pat. No. 4,203,302 assigned to the assignee of the present invention, and which includes the condenser coils and evaporator coils of cylindrical configuration contained within a vertically oriented housing adapted to be mounted in the floor of a facility.

SUMMARY OF THE INVENTION

In brief, the present invention provides an air conditioner especially adapted for mounting in an opening of a floor of a room or other facility and which is an improvement over that shown in the aforesaid U.S. Pat. No. 4,203,302. The novel air conditioner comprises a housing having a bottom duct adapted for installation in a mounting opening in the floor and a top duct from which cool air can be admitted into a room. Within the housing is contained a compresser and associated condenser and evaporator coils and blowers. The condenser coils are wound in a conical configuration and are disposed about a vertical axis, while the evaporator coils have a cylindrical configuration and are disposed about the same vertical axis above the condenser coils. A drip pan separates the condenser and evaporator coils and includes openings through which condensate can be discharged by gravity feed onto the condenser coils for evaporation. The conical configuration of the condenser coils provides greater exposure of the coils to incoming air and permits relatively large air flow without increasing the housing size or the air velocity. A condenser fan is associated with the bottom duct for blowing hot air through the mounting opening away from the room being cooled. An evaporator fan is associated with the upper duct for blowing cool air into the room, and a compressor fan is associated with the upper duct for blowing cool air towards the compressor and then towards the bottom duct where it is exhausted by the condenser fan.

The invention is especially useful in buildings which are raised off of the ground, and buildings having interior rooms with no windows. The novel air conditioner can be readily installed in a mounting opening in the floor with the same ease as a window mounted unit but without the disadvantages of a window mounting. Floor mounting is especially advantageous as the floor in a building is usually a much better structural support than a wall, and thus the present floor mounted air conditioner will exhibit less vibration and noise than a conventional window mounted unit.

DESCRIPTION OF THE DRAWING

The invention will be more fully understood from the following detailed description taken in conjunction with the accompanying drawing, in which the single FIGURE is a cross-section elevation view of the air conditioner according to the invention.

DETAILED DESCRIPTION OF THE INVENTION

Figure 1:
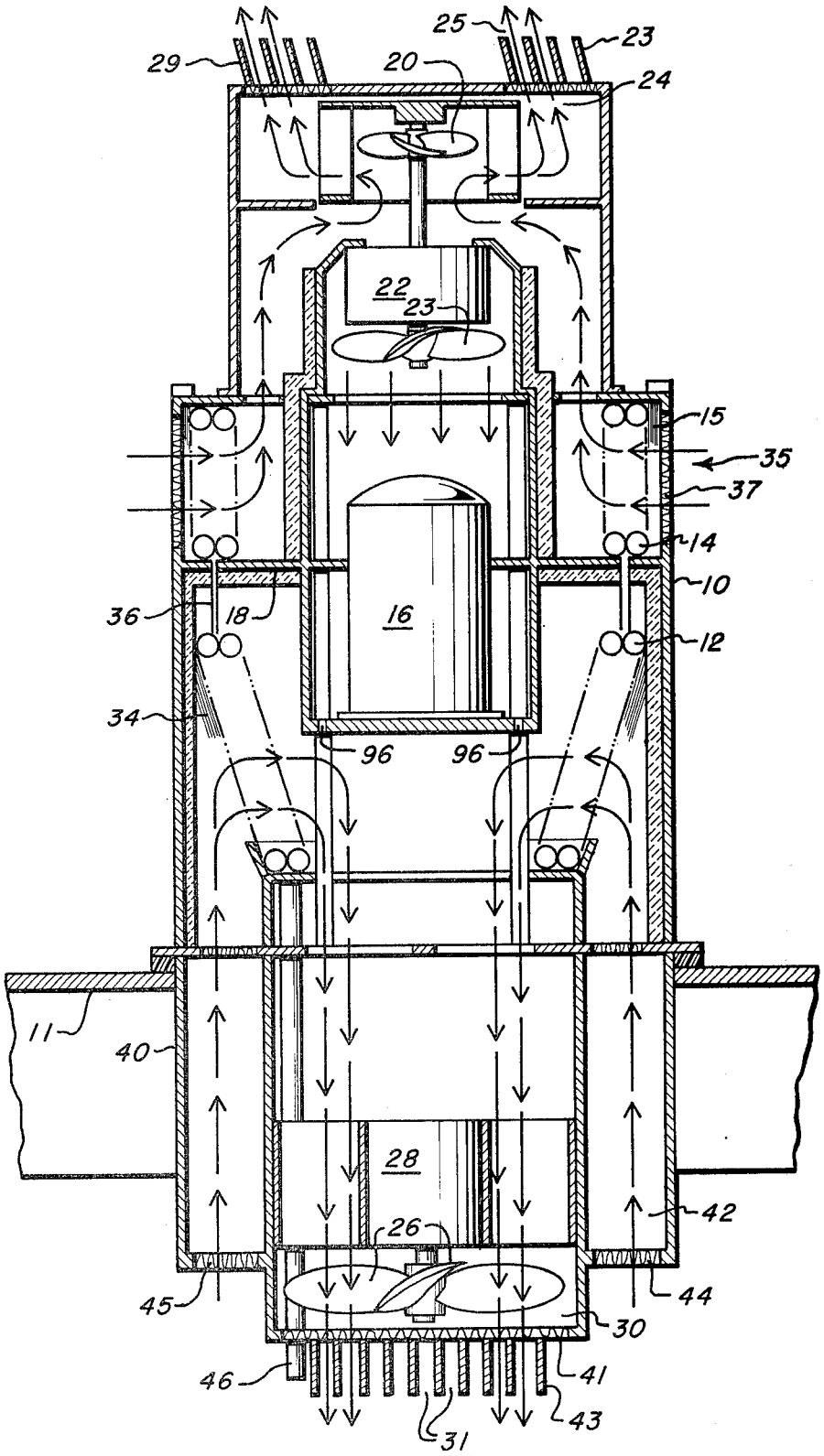

Referring to the drawing, there is shown an air conditioner similar to the air conditioner described in U.S. Pat. No. 4,203,302. This air conditioner comprises a housing 10 having disposed therein conically wound condenser coils 12 disposed about a vertical axis. Cylindrical evaporation coils 14 are disposed above and coaxially with the condenser coils. Coils 12 and 14 are connected to a compressor 16 in a usual refrigeration loop. A drip pan 18 is disposed within the housing and separates the condenser coils and the evaporator coils. A fan 20 is disposed at the top of the housing and is driven by an associated motor 22 for blowing cooled air out of the discharge duct 24 via an exhaust port 25. A second fan 26 and associated motor 28 are disposed at the bottom of the housing and are operative to blow heated air out of the bottom duct 30 through a port 31 which typically has a screen 41 thereover to prevent entry of insects or debris into the housing. A cylindrical filter 15 is provided around the evaporator coils 14 and a conical wick 34 is provided around the condenser coils 12. Wick 34 is of a loose woven material which does not unduly restrict air flow and which absorbs condensate directed onto the wick from one or more tubes 36 in the drip pan 18 during operation of the air conditioner. An annular air inlet 35 is provided at the top of housing 10 and usually includes an air filter 37. The cooled air port 25 of duct 24 can include a set of deflectors 29 which are moveable selectively for directing the air flow into the room. Another fan 23, driven by motor 22, is disposed above the compressor 16 and directs a portion of the cooled air flow downwardly over the compressor and through apertures 96. Air passing through apertures 96 is entrained into the air flow passing over condenser coils 12 and is exhausted by fan 26 through bottom duct 30.

The housing 10 is adapted for mounting of the air conditioner unit through an opening in the floor 11 of a room or other area to be cooled. As illustrated, the lower portion of the housing includes a wall 40 which can be inserted into a mounting opening in the floor. The wall 40 is spaced from the hot air exhaust duct 30 and provides a surrounding peripheral duct 42 having inlet openings 44 into which air is drawn, and typically having a screen 45. Air drawn into the annular duct 42 passes through the wick 34 and over the condenser coils 12 for cooling of the coils. Heated air from the condenser coils is exhausted down through the lower duct 30 by means of exhaust fan 26. Condensation from the evaporation coils 14 drips into the drip pan 18 where the condensate is discharged onto the wick for uniform distribution of the condensate around the condenser coils to aid in cooling of these coils. The conical configuration of the condenser coils provides exposure of substantially all of the coils to the incoming air in duct 42 and permits this duct to be relatively large to achieve substantial air flow without increasing the size of the housing or increasing the air velocity. As a result, the air conditioner operates quietly and provides efficient cooling in a small size unit. Excess condensate is discharged from the bottom of the unit below the floor via pipe 46. Air drawn in through air inlet 35 from within the buidling passes over evaporator coils 14 for cooling, the cooled air then being blown by fan 20 out through duct 24. Some of this cooled air is also drawn downwardly by fan 23 in an intermediate portion of the housing 10 toward the compressor 16. This cooled air passes over the compressor and through apertures 96 where it is entrained into the flow of air passing over condensing coils 12 and is exhausted by fan 26. Deflectors 43 can be provided at the port 31 for adjusting the flow of hot exhaust air away from the unit.

The floor mounted air conditioner described above has major benefits in comparison with air conditioning units of conventional construction. Cooler air can be drawn from under the floor, such as in a basement area for greater efficiency in comparison to air drawn in by a window mounted unit. In addition, the air conditioning unit by reason of its internal floor mounting is not exposed to sun, rain and other environmental conditions which adversely affect the efficiency and durability of conventional units. By reason of its internal floor mounted configuration, there is no protrusion from the window or wall to mar the appearance of a building or to drip condensate from the side of a building. Nor are brackets or elaborate mounting arrangements needed; the novel unit is simply "plugged in" to the floor mounting opening. Moreover, the air conditioner is not in an external position subject to accidental or intentional damage.

The housing in preferred embodiment is of generally cylindrical configuration. The peripheral wall 40 is preferably of truncated cylindrical shape having opposite cylindrical segments joined by straight segments. The straight segments are spaced to fit between the joists of a standard wood floor. It will be appreciated that modifications can be made without departing from the true scope of the invention and that this invention is not to be limited except as indicated in the appended claims.

What is claimed is:

1. A floor mounted air conditioner comprising:

a housing having a lower portion and an upper portion, the lower portion of the housing including a wall insertable into a mounting opening in the floor of a room to be cooled, the upper portion of the housing being disposable above the floor and having a cold air exhaust duct upwardly extending from the upper portion and terminating in an upper cold air exhaust port;

a peripheral inlet at the top of the upper portion of said housing for drawing air from the room into the housing for cooling, said inlet surrounding and being spaced from said upper cold air exhaust port;

a hot air exhaust duct in the lower portion of said housing terminating in a lower hot air exhaust portion at the bottom end of the lower housing portion below the mounting floor;

a peripheral duct in the lower housing portion defined by the wall of the lower housing portion and the hot air exhaust duct and having inlet openings in the wall of the lower housing portion into which air is drawn from below the floor into the housing for cooling;

a compressor within the housing;

conically configured condenser coils disposed about a vertical axis in the housing;

cylindrically configured evaporator coils disposed about said vertical axis in said housing above said condenser coils;

a drip pan in said housing separating said condenser and evaporator coils and including one or more openings arranged to discharge condensate onto said condenser coils;

a condenser fan in said hot air exhaust duct for blowing hot air from said housing out of said lower hot air exhaust port into the space below the floor;

an evaporator fan disposed in the upper cold air exhaust duct for blowing cool air out of said upper cold air exhaust port into the room; and a compressor cooling fan for blowing cooled air from said cold air exhaust duct past said compressor and toward said hot air exhaust duct.

2. An air conditioner for floor mounting in communication with inside air of an enclosure and under floor outside air, comprising:

a unitary housing having a lower portion, an intermediate portion, and an upper portion, said portions being co-axially aligned substantially about the vertical axis of the unitary housing;

outside air heat exchanger coils positioned within and symmetrically disposed about the vertical axis of said lower housing portion;

said lower housing portion being adapted for limited insertion into a floor opening and having outside air ducting for communication with under floor outside air and lower exhaust porting;

said outside air ducting being adapted to direct the circulation of said outside air up and over said outside air heat exchanger coils and downward through said lower exhaust porting for returning said outside air to the outside;

an outside air fan rotatable about a normally vertical axis for causing outside air circulation as directed by said outside air ducting;

inside air heat exchanger coils positioned within and symmetrically disposed about the vertical axis of said upper housing portion;

said upper housing portion having peripheral openings for communication with inside air, upper exhaust porting, and inside air ducting for directing the circulation of inside air inwardly through said peripheral openings in said upper housing portion and over said inside air heat exchanger coils and upward through said upper exhaust porting for returning said inside air to the inside;

an inside air fan rotatable about a normally vertical axis for causing inside air to circulate as directed by said inside air ducting;

a condensate collector and barrier positioned between said inside air heat exhanger coils and said outside air heat exchanger coils for collecting condensate from said inside air heat exchanger coils, for directing said condensate therethrough by gravity feed over said outside air heat exchanger coils to aid in the cooling thereof by evaporation, and for isolating said inside air heat exchanger coils from said outside air heat exchanger coils;

a compressor mounted within said intermediate portion and thermally and acoustically insulated from said inside air; and a compressor fan mounted within said housing and cooperative with said inside air ducting for directing a portion of said inside air over said compressor to aid in the cooling thereof, and downwardly thereover to said lower exhaust porting.

3. A floor mounted air conditioner comprising:

a housing having a lower portion and an upper portion, the lower portion of the housing including a wall insertable into a mounting opening in the floor of a room to be cooled, the upper portion of the housing being disposable above the floor and having a cold air exhaust duct upwardly extending from the upper portion and terminating in an upper cold air exhaust port;

a peripheral annular inlet in said housing for drawing air from the room into the housing for cooling, said inlet surrounding and being spaced from said upper cold air exhaust port;

a hot air exhaust duct in the lower portion of said housing terminating in a lower hot air exhaust portion at the bottom end of the lower housing portion below the mounting floor;

a peripheral duct in the lower housing portion defined by the wall of the lower housing portion and the hot air exhaust duct and having inlet openings in the wall of the lower housing portion into which air is drawn from below the floor into the housing for cooling;

a compressor within the housing;

condenser coils disposed about a vertical axis in the housing;

evaporator coils disposed about said vertical axis in said housing above said condenser coils;

a condenser fan in said hot air exhaust duct for blowing hot air from said housing out of said lower hot air exhaust port into the space below the floor;

an evaporator fan disposed in the upper cold air exhaust duct for blowing cool air out of said upper cold air exhaust port into the room; and a compressor cooling fan adapted for blowing cooled air from said cold air exhaust duct past said compressor and toward said hot air exhaust duct.

4. The floor mounted air conditioner of claim 1 wherein said peripheral duct is operative to direct air from the inlet openings below the mounting floor over the condenser coils to aid in the cooling thereof.

5. The floor mounted air conditioner of claim 1 further including a loose weave wick disposed around said condenser coils in a position to receive condensate from openings in said drip pan for uniform distribution of condensate around said condenser coils to aid in the cooling thereof.

6. The floor mounted air conditioner of claim 1 including a drain pipe downwardly disposed from said housing and operative to discharge condensate collected from said evaporator coils.

7. The floor mounted air conditioner of claim 1 further including deflectors at the upper cold air exhaust port for directing the cooled air flow therefrom.

8. The floor mounted air conditioner of claim 1 further including deflectors at the lower hot air exhaust port for directing the hot air flow therefrom.

9. The air conditioner for floor mounting of claim 2, wherein at least the upper and the intermediate portions of said housing have an approximately circular cross-section.

10. The air conditioner for floor mounting of claim 2, wherein said outside air heat exchanger coils are conically shaped to provide exposure to substantially all of the coils to the air flow thereover.

* * * * *